US007469556B2

(12) United States Patent
Howard

(10) Patent No.: US 7,469,556 B2
(45) **Date of Patent: *Dec. 30, 2008**

(54) NATURAL GAS LIQUEFACTION SYSTEM

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/809,449

(22) Filed: Jun. 1, 2007

(65) Prior Publication Data

US 2007/0234755 A1 Oct. 11, 2007

Related U.S. Application Data

(63) Continuation of application No. 10/975,077, filed on Oct. 28, 2004, now Pat. No. 7,228,714.

(51) Int. Cl.
*F25J 1/00* (2006.01)

(52) U.S. Cl. ..... 62/611; 62/613

(58) Field of Classification Search ..... 62/611, 62/612, 613

See application file for complete search history.

(56) References Cited

U.S. PATENT DOCUMENTS

| | | | | |
|---|---|---|---|---|
| 3,182,461 | A | 5/1965 | Johanson | |
| 3,360,944 | A | 1/1968 | Knapp et al. | |
| 3,433,026 | A | 3/1969 | Swearingen | |
| 3,616,652 | A | 11/1971 | Engel | |
| 3,818,714 | A * | 6/1974 | Etzbach et al. | 62/612 |
| 6,041,620 | A | 3/2000 | Olszewski et al. | |
| 6,158,240 | A | 12/2000 | Low et al. | |
| 6,289,692 | B1 | 9/2001 | Houser et al. | |
| 6,308,531 | B1 | 10/2001 | Roberts et al. | |
| 6,694,774 | B1 | 2/2004 | Rashad et al. | |
| 7,228,714 | B2 * | 6/2007 | Howard | 62/613 |
| 2003/0005722 | A1 | 1/2003 | Wilkinson et al. | |
| 2004/0003625 | A1 * | 1/2004 | Fischer et al. | 62/612 |

OTHER PUBLICATIONS

Timmerhaus, et al., Cryogenic Process Engineering:, Plenum Press, 1989 pp. 128-141.

* cited by examiner

*Primary Examiner*—William C Doerrler
(74) *Attorney, Agent, or Firm*—Donald T. Black

(57) ABSTRACT

A method for producing liquefied natural gas wherein high pressure liquid natural gas is subcooled and then flashed to form flash vapor and liquefied natural gas product, and the flash vapor is employed in a refrigeration cycle to generate refrigeration for subcooling the liquid natural gas.

4 Claims, 1 Drawing Sheet

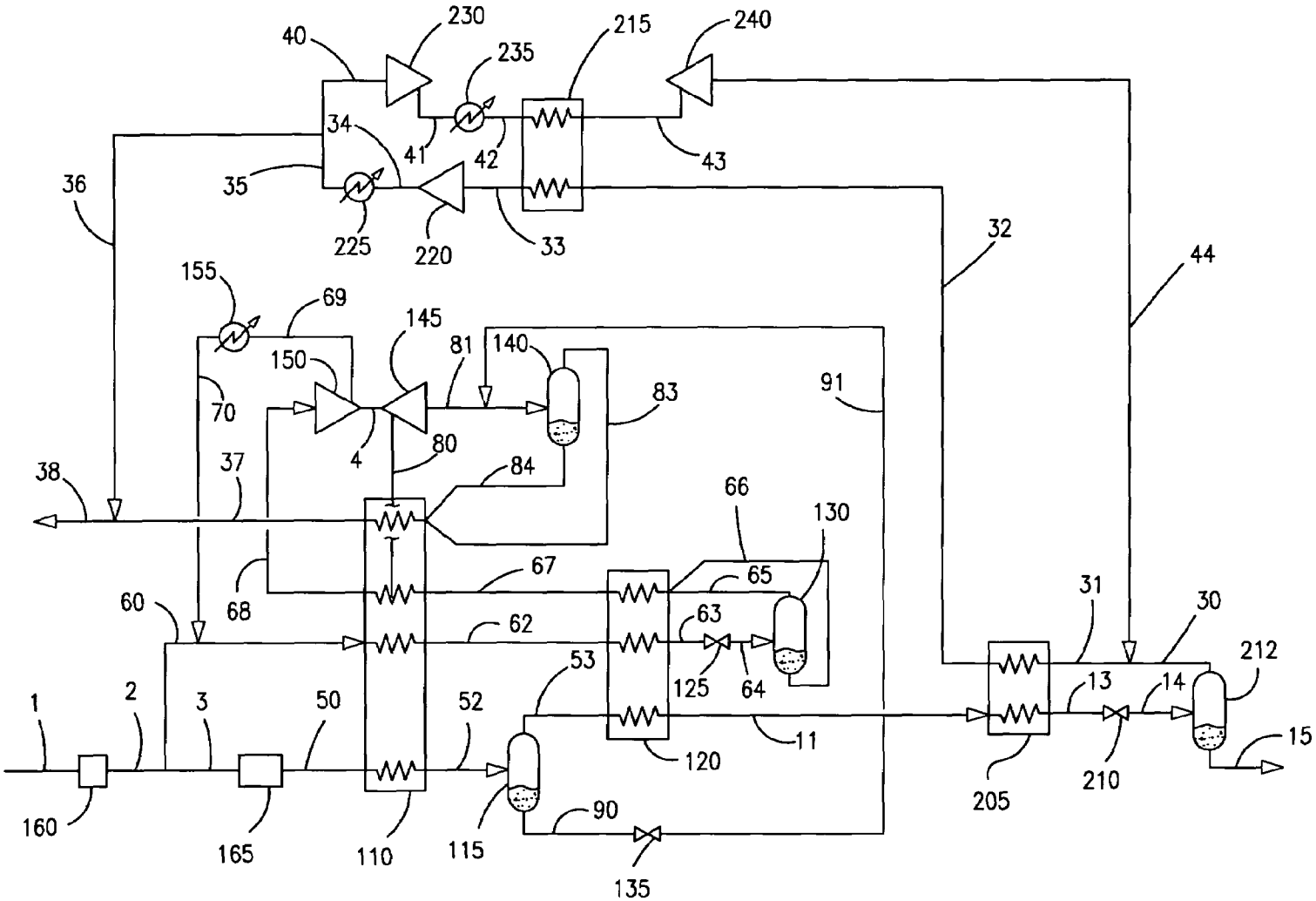
15
212
44
30
14
210
31
13
205
32
91
130
11
240
43
66
65
64
63
125
120
135
215
83
90
33
53
235
42
140
84
67
62
115
230
41
220
81
80
52
145
110
34
225
4
69
150
50
165
40
35
155
70
37
68
3
60
2
36
38
1
160

NATURAL GAS LIQUEFACTION SYSTEM

This application is a continuation of and claims priority from U.S. application Ser. No. 10/975,077, filed Oct. 28, 2004 now U.S. Pat. No. 7,228,714.

TECHNICAL FIELD

This invention relates generally to the production of liquefied natural gas.

BACKGROUND ART

Typically natural gas transmission pipelines operate at pressures ranging between 700 and 1500 psia. Natural gas pressure reduction points are often referred to as let-down stations. Such stations enable the regional distribution of natural gas (typically at pressures of 150 to 500 psia). In general, let-down stations are not designed for the useful recovery of the pressure energy. Processes which serve to let-down natural gas while producing a fraction of the inlet gas as liquefied natural gas are often referred to as expander cycles or expander plants.

It is an object of this invention to provide an improved method for employing pressure energy to produce liquefied natural gas.

SUMMARY OF THE INVENTION

The above and other objects, which will become apparent to those skilled in the art upon a reading of this disclosure, are attained by the present invention which is:

A method for producing liquefied natural gas comprising:

(A) compressing a refrigeration gas and turboexpanding the compressed refrigeration gas to produce cooled refrigeration gas;

(B) subcooling liquid natural gas and flashing the subcooled natural gas to produce flash vapor and liquefied natural gas; and (C) warming the flash vapor and the cooled refrigeration gas by indirect heat exchange with the liquid natural gas to effect the subcooling of the liquid natural gas.

As used herein the term "flashing" means depressurizing a liquid through an expansion device with the conversion of a portion of the liquid to the vapor phase.

As used herein the term "Joule-Thomson expansion" means expansion employing an isenthalpic pressure reduction device which typically may be a throttle valve, orifice or capillary tube.

As used herein the term "turboexpansion" means an expansion employing an expansion device which produces shaft work. Such shaft work is produced by the rotation of a shaft induced by the depressurization of a fluid through one or more fluid conduits connected to the shaft, such as a turbine wheel.

As used herein the term "indirect heat exchange" means the bringing of two fluids into heat exchange relation without any mixing of the fluids with each other.

As used herein the term "subcooling" means cooling a liquid to be at a temperature lower than the saturation temperature of that liquid for the existing pressure.

BRIEF DESCRIPTION OF THE DRAWING

The sole FIGURE is a simplified schematic representation of one preferred embodiment of the natural gas liquefaction method of this invention.

DETAILED DESCRIPTION

In general, the invention comprises an improved method for liquefying natural gas using the pressure energy of the natural gas wherein flash vapor from natural gas depressurization is employed in a refrigeration cycle for subcooling high pressure natural gas prior to flashing.

The invention will be described in greater detail with reference to the Drawing. Referring now to the FIGURE, high pressure natural gas stream 1, which is at a pressure generally within the range of from 700to 1500 pounds per square inch absolute (psia), is cleaned of high boiling impurities, such as water and hydrogen sulfide, by passage through treatment system 160, which may be a thermal swing adsorption system. Resulting natural gas stream 2 is divided into portions 60 and 3. Portion 60 is cooled in heat exchanger 110, emerging therefrom as cooled stream 62. Portion 3 is passed to additional purification system 165 for the removal of carbon dioxide to a level generally less than 50 ppm. Resulting further cleaned natural gas stream 50 is cooled by passage through heat exchanger 110, emerging therefrom as two phase stream 52. Cooled gas stream 62 is further cooled by indirect heat exchange with expanded gas in heat exchanger 120 as will be more fully described below to produce further cooled stream 63 which has a temperature less than −116.5° F. which is the critical temperature of methane.

Cooled natural gas stream 63 is expanded in a first expansion, such as by passing through Joule-Thomson valve 125, to produce an expanded gas stream 64 at a first temperature, which is typically within the range of from −120 to −200° F. The first expansion may be with or without the production of shaft work. In the embodiment of the invention illustrated in the FIGURE, the first expansion is a Joule-Thomson expansion which results in a two-phase stream 64 which is passed to phase separator 130 wherein it is separated for purposes of distribution, in vapor stream 65 and liquid stream 66, into a common pass of heat exchanger 120 and subsequently in heat exchanger 110. Alternatively streams 66 and 65 may be warmed in separate passages of each of heat exchangers 120 and 110. Although illustrated as separate elements in the FIGURE, those skilled in the art will recognize that heat exchangers 120 and 110 may be combined into a single core.

The expanded gas stream is warmed by passage through heat exchanger 120 to provide cooling to the product natural gas stream, as will be more fully described below. Resulting expanded gas stream 67 is further warmed in heat exchanger 110 to provide cooling by indirect heat exchange to the product natural gas stream and also to the cooling gas stream 60.

A portion 80 of stream 67, typically from 30to 60 percent of stream 67, is withdrawn after partial traverse of heat exchanger 110 and passed to turboexpander 145 wherein it is turboexpanded to provide turboexpanded gas stream 81 having a second temperature which exceeds the first temperature. Generally the temperature of turboexpanded gas stream 81 will be at least 30° F. greater than the temperature of expanded gas stream 64. The temperature of turboexpanded gas stream 81 is typically within the range of from −30 to −100° F.

In the embodiment of the invention illustrated in the FIGURE, turboexpanded stream 81 is passed to phase separator 140 and the vapor and liquid fractions are passed in respective streams 83 and 84 to a common pass of heat exchanger 110. Within heat exchanger 110 the turboexpanded gas stream is warmed by indirect heat exchange to provide cooling to gas stream 60 and also to the product natural gas stream. Resulting warmed turboexpanded gas stream 37 is withdrawn from heat exchanger 110 and may be recovered in stream 38.

A portion 68 of expanded gas stream 67 which is not passed to the turboexpander, is passed to compressor 150, which is preferably powered by the shaft work of expansion derived from turboexpander 145 and illustrated in representational form 4. After compression, the gas in stream 69 may be cooled in heat exchanger 155 and resulting stream 70 may be combined with stream 60 for passage to heat exchanger 110 and processing as was previously described.

Two-phase natural gas stream 52 is passed to phase separator 115. Liquid is withdrawn from phase separator 115 in stream 90, passed through valve 135 and, in the embodiment illustrated in the FIGURE, passed in stream 91 for combination with stream 81 and further processing as was described above. Vapor is withdrawn from phase separator 115 in stream 53 and further cooled by passage through heat exchanger 120 by indirect heat exchange and warming Joule-Thomson expanded natural gas to form liquid natural gas in stream 11 having a pressure generally within the range of from 700 to 1500 psia and a temperature generally within the range of from −120 to −180° F. Stream 11 is subcooled to a temperature within the range of from −200 to −260° F. by passage through heat exchanger 205 to form subcooled liquid natural gas stream 13. Stream 13 is flashed by passage through valve 210 to form two-phase stream 14 having a pressure generally within the range of from 14.7 to 40 psia.

Two-phase stream 14, which comprises flash vapor and liquefied natural gas, is passed into phase separator 212 from which product liquefied natural gas is withdrawn and recovered in stream 15. Flash vapor is withdrawn from phase separator 212 in stream 30 and combined with refrigeration gas in stream 44 to subcool the liquid natural gas 11 as will be more fully described below.

Refrigeration gas 33, which has been warmed to about ambient temperature by passage through heat exchanger 215, is compressed by passage through compressor 220 and resulting compressed refrigeration gas 34 is cooled of the heat of compression by passage through heat exchanger 225 to form stream 35. A portion 36 of stream 35 is removed from the refrigeration gas cycle and preferably recovered as natural gas, most preferably as illustrated in the FIGURE, by combination with stream 37 to form stream 38. The remaining portion 40 of the compressed refrigeration gas is further compressed by passage through compressor 230 to form further compressed refrigeration gas 41 having a pressure within the range of from 150 to 350 psia. Stream 41 is cooled of the heat of compression by passage through cooler 235 and resulting refrigeration gas stream 42 is cooled by passage through heat exchanger 215 to a temperature within the range of from −70 to −170° F. Cooled refrigeration gas is passed in stream 43 from heat exchanger 215 to turboexpander 240 wherein it is turboexpanded to a pressure within the range of from 14.7 to 40 psia to generate refrigeration. The shaft work produced by turboexpander 240 is preferably employed to provide at least some of the power to operate compressor 230.

Resulting refrigeration bearing refrigeration gas from turboexpander 240 is warmed in heat exchanger 205 to effect the subcooling of the liquid natural gas in stream 11. Preferably, as illustrated in the FIGURE, the cooled refrigeration gas in stream 44 is combined with the flash vapor in stream 30 to form combined stream 31 which is passed to heat exchanger 205 and warmed by indirect heat exchange to effect the subcooling of the liquid natural gas. The resulting warmed refrigeration gas is passed in stream 32 to heat exchanger 215, emerging therefrom in stream 33 for processing as was previously described.

Although the invention has been described in detail with reference to a certain preferred embodiment, those skilled in the art will recognize that there are other embodiments of the invention within the spirit and the scope of the claims.

The invention claimed is:

1. A method for producing liquefied natural gas comprising:

(A) compressing a refrigeration gas and turboexpanding the compressed refrigeration gas to produce cooled refrigeration gas;

(B) subcooling liquid natural gas and flashing the subcooled natural gas to produce flash vapor and liquefied natural gas; and (C) warming the flash vapor and the cooled refrigeration gas by indirect heat exchange with the liquid natural gas to effect the subcooling of the liquid natural gas, and combining all of the flash vapor and the refrigeration gas.

2. The method of claim 1 wherein a portion of the refrigeration gas is withdrawn prior to turboexpansion.

3. The method of claim 1 wherein the flash vapor and the cooled refrigeration gas, after the said warming, are compressed to form the said compressed refrigeration gas.

4. The method of claim 1 wherein the subcooled liquid natural gas has a pressure within the range of from 700 to 1500 psia, and the flash vapor and liquefied natural gas resulting from the flashing of the subcooled natural gas have a pressure within the range of from 14.7 to 40 psia.

* * * * *